US012004655B2

(12) United States Patent
Goodworth

(10) Patent No.: US 12,004,655 B2
(45) Date of Patent: Jun. 11, 2024

(54) STACKABLE MOLDED PLASTIC ROCKING CHAIR

(71) Applicant: Adams Mfg. Corp., Portersville, PA (US)

(72) Inventor: Matthew Goodworth, Pittsburgh, PA (US)

(73) Assignee: Adams Mfg. Corp., Portersville, PA (US)

( * ) Notice: Subject to any disclaimer, the term of this patent is extended or adjusted under 35 U.S.C. 154(b) by 0 days.

(21) Appl. No.: 17/719,748

(22) Filed: Apr. 13, 2022

(65) Prior Publication Data

US 2022/0330701 A1 Oct. 20, 2022

Related U.S. Application Data

(60) Provisional application No. 63/174,809, filed on Apr. 14, 2021.

(51) Int. Cl.
*A47C 3/029* (2006.01)
*A47C 3/04* (2006.01)
*A47C 5/12* (2006.01)

(52) U.S. Cl.
CPC ..... *A47C 3/029* (2013.01); *A47C 3/04* (2013.01); *A47C 5/12* (2013.01)

(58) Field of Classification Search
CPC ..... A47C 3/029; A47C 3/04; A47C 5/12
See application file for complete search history.

(56) References Cited

U.S. PATENT DOCUMENTS

| | | | | | |
|---|---|---|---|---|---|
| 2,098,888 | A * | 11/1937 | Schadler | A47C 3/04 297/239 |
| 2,874,755 | A * | 2/1959 | Smith | A47C 3/04 297/183.1 |
| 3,095,236 | A | 6/1963 | Klassen | |
| 3,446,530 | A | 5/1969 | Rowland | |
| 3,600,036 | A | 8/1971 | Iskander | |
| 4,341,419 | A | 7/1982 | Sebel | |
| 4,648,653 | A | 3/1987 | Rowland | |
| 5,002,337 | A | 3/1991 | Engel et al. | |
| 5,088,792 | A * | 2/1992 | Guichon | A47C 5/12 297/451.12 |
| 5,383,712 | A | 1/1995 | Perry | |
| 7,252,333 | B2 | 8/2007 | Caldwell | |
| 7,401,854 | B2 | 7/2008 | Adams | |
| 8,070,229 | B2 | 12/2011 | Woodring | |

(Continued)

*Primary Examiner* — David R Dunn
*Assistant Examiner* — Tania Abraham
(74) *Attorney, Agent, or Firm* — Buchanan Ingersoll & Rooney PC

(57) ABSTRACT

A stackable rocking chair has a seat, a back, a right front leg and a left front leg attached to the seat, a right rocker and a left rocker, a right rear leg connected to the seat and the right rocker and a left rear leg connected to the seat and the left rocker, a right arm and a left arm that extend from the back and an arm support for each arm. The lower end of each arm support is attached to a rocker and the upper end of each arm support is attached to an arm. Each arm support is adjacent and substantially parallel to one of the front legs, such that there is a gap between the front leg and the arm support. One stackable rocker can be stacked on another stackable rocker by positioning the rockers of one chair within the gaps in the other chair.

26 Claims, 8 Drawing Sheets

(56) References Cited

U.S. PATENT DOCUMENTS

| | | | | |
|---|---|---|---|---|
| 8,191,963 | B2 * | 6/2012 | Gamboa | A47C 7/68 297/451.12 |
| 8,313,141 | B2 | 11/2012 | Woodring | |
| 8,333,430 | B2 * | 12/2012 | Adams | A47C 7/462 297/181 |
| D688,885 | S | 9/2013 | Adams et al. | |
| 8,960,792 | B1 | 2/2015 | Woodring | |
| 9,504,329 | B2 | 11/2016 | Adams, IV et al. | |
| 9,510,681 | B2 * | 12/2016 | Woodring | A47C 3/04 |
| 9,675,176 | B2 * | 6/2017 | Adams, IV | B29C 45/16 |
| 10,016,058 | B2 | 7/2018 | Adams et al. | |
| 10,455,939 | B2 | 10/2019 | Woodring | |

* cited by examiner

STACKABLE MOLDED PLASTIC ROCKING CHAIR

CROSS REFERENCE TO RELATED APPLICATION

This application is related to and claims the benefit of U.S. Provisional Application No. 63/174,809 filed on Apr. 14, 2021, the entire contents are incorporated herein by reference.

FIELD OF THE INVENTION

The present invention relates to molded plastic chairs. More particularly, the present invention relates to a molded plastic rocking chair that can be stacked on an identical rocking chair.

BACKGROUND OF THE INVENTION

A wide variety of molded plastic chairs that stack one upon another are available in the marketplace. These prior art chairs have a seat, a back, front legs and rear legs directly connected to the seat, and usually have arms extending from the seat to the back. Each arm creates an opening bounded by that arm, the back and the seat. The legs extend outwardly from vertical to enable the chairs to be stacked one on top of another. In some stackable plastic chairs the rear legs of the uppermost chair extend through the openings bounded by the arms, back and seat of the chair below that chair in the stack. Stackable chairs have an advantage in that they can be stacked upon one another and placed on a pallet for easy transport. A retailer may display the stacked chairs on the same pallet on which they have been shipped. Consumers may also store several stackable chairs stacked one upon another. Plastic chairs are also advantageous because they are comfortable, inexpensive to manufacture, practical, lightweight, portable, water and weatherproof, sturdy, attractive, relatively easy to care for, and easy to move to and from a stacked arrangement.

U.S. Pat. Nos. 4,341,419 and 5,002,337 disclose examples of stackable side chairs. U.S. Pat. No. 7,401,854 discloses a stackable folding Adirondack chair. U.S. Pat. No. D688,885 discloses a stackable bar stool. All of these chairs have four legs with feet that rest on the floor or ground. For many years there has been a need for a stackable plastic rocking chair.

Woodring in a series of related patents including U.S. Pat. Nos. 8,070,229, 8,313,141 and 8,960,792 discloses a monobloc rocking chair which is injection molded in one piece. This chair was designed to place the arms as wide as possible to give it the appearance of a traditional Adirondack chair. He teaches that the side walls of the chair which includes the legs and the rockers must diverge outwardly from the top of the chair to the bottom so that the chairs can be stacked. Woodring's rocker has the rockers outboard of the arms. Because of the outward divergence of the legs, the relatively small contact area between the floor and the rockers and the fact that the contact area changes as a person rocks in the chair, the rockers in the Woodring rocking chair can splay outwardly when a person sitting on the chair rocks back and forth. Continued rocking can cause the legs to break or cause the rockers to break away from the legs, breakage being more likely as the weight on the chair increases.

U.S. Pat. No. 9,504,329 discloses a stackable, plastic molded rocking chair in which the rockers have a base with a curvature that can prevent the rockers from splaying outward when weight is dropped on the chair or while a person is rocking the chair. Like Woodring's rocking chair, the side walls, legs and the rockers of this stackable rocking chair diverge outwardly from the top of the chair to the bottom so that the chairs can be stacked.

U.S. Pat. No. 3,446,530 to D. L. Rowland for Nested Armchair discloses a stackable side chair having a wire frame. A U-shaped rod forms the legs on each side of the chair. There is a right arm and a left arm that extend from the back. An arm support made of an L-shaped metal rod is provided for each arm. The upper end of each arm support is attached to the arm and the lower portion of each arm support is attached to the base of a U-shaped leg which creates a gap between the seat and the upright. One chair can be stacked upon another chair by positioning each of the U-shaped legs of one chair within one of the gaps between the seat and an arm support of a second identical chair. There have been no similar chairs made of plastic because of doubts or concerns that a plastic chair would not meet applicable safety standards.

Plastic chairs for outdoor use must meet certain standard performance requirements. ASTM F 1561-03 standard sets forth specific tests to be performed in order to determine if a plastic chair meets those requirements. One test involves placing the chair on a glass surface which simulates smooth surfaces such as linoleum and wet pool decks. 300-400 pounds is placed on the chair. The chair must then hold for at least 30 minutes without failing. Failure occurs when the chair collapses or when any visible evidence of structural damage develops such as cracking. Chairs are often left up beyond 30 minutes to further evaluate performance even though that is not specified as necessary per the ASTM standard. Another test involves dropping a bag of shot onto the seat of the chair from a height of six inches above the seat. This test is conducted using a bag that weighs 150-250 pounds. The impact is repeated ten times. There must be no breakage or structural damage. The static load and impact tests are then repeated on plywood to simulate rougher surfaces such as textured concrete or treated lumber used on a deck. There are other tests required by the ASTM standard, but the tests described above are the core tests for that standard.

Retailers may require that other tests in addition to those outlined in the ASTM standard must be passed before they will sell a resin chair. The other tests may be derived from other standards that exist in the industry. BIFMA X5.1 requires that the chairs must pass one impact of 225 lbs. from six inches. Additional required tests may be "home-grown" where the retailer creates their own protocol such as one intended to simulate actual use. One example is a test where a rocking chair is loaded with weight such as used in a standard static load test and then rocked for a large number of cycles. Finally, there are test protocols for chairs intended to be marketed to large occupants. These chairs must withstand impacts of greater than 225 lbs.

Molded plastic rocking chairs may be required to pass any or all of the tests described above, or other tests not described herein, to be deemed sufficient for retail distribution. It is unlikely that rocker like that illustrated in the Woodring patents or a plastic version of Rowland's armchair will pass all of the required tests.

Consequently, there is a need for a stackable plastic rocking chair that will pass all tests that may be required for retail distribution.

SUMMARY OF THE INVENTION

I provide a stackable rocking chair having a seat, a back attached to the seat, a right front leg and a right rear leg connected to the seat and a right rocker as well as a left front leg and a left rear leg connected to the seat and a left rocker. There is a right arm and a left arm that extend from the back and an arm support for each arm. Each arm support has an upright and also may have a spacer. The upper end of each upright is attached to an arm. Each upright is adjacent and substantially parallel to one of the front legs. There is a gap between the front leg and the upright. I prefer to provide a spacer that is connected between a front leg and the lower end of the upright. However, the gap can be created by attaching the upright to the outer side of the rocker or by using a spacer and by attaching the upright to the outer side of the rocker. This gap has a width greater than the width of the rockers. One stackable rocker can be stacked on another stackable rocker by positioning the rockers of one chair within the gaps between the front legs and the arm supports of a second chair.

I prefer that the spacers be sized and positioned so that when a second substantially identical stackable rocking chair having a right rocker and a left rocker is stacked on my stackable rocking chair the right rocker of the second substantially identical rocking chair rests on the right spacer of the first chair and the left rocker of the second substantially identical rocking chair rests on the left spacer of the first chair.

I also prefer to provide a cross member having one end connected to the right rear leg and an opposite end connected to the left rear leg. I provide at least one brace having one end connected to the cross member and an opposite end connected to the back. The cross member may be sized and shaped to rest upon the seat or back of a rocking chair upon which the rocking chair having this cross member is stacked.

The arm supports are preferably hollow. The upper end of either or both arm supports may be kept open and a floor can be provided within the upper end to create a pocket for a cell phone or other items. A portion of one or two walls of the arm support can also be a wall or walls of the pocket.

Preferably this stackable rocker is plastic. The plastic may be polypropylene, calcium filled polypropylene or talc filled polypropylene.

Other features and advantages of my stackable rocking chair will become apparent from certain present preferred embodiments thereof which are shown in the drawings.

DESCRIPTION OF THE PREFERRED EMBODIMENTS

Figure 1:
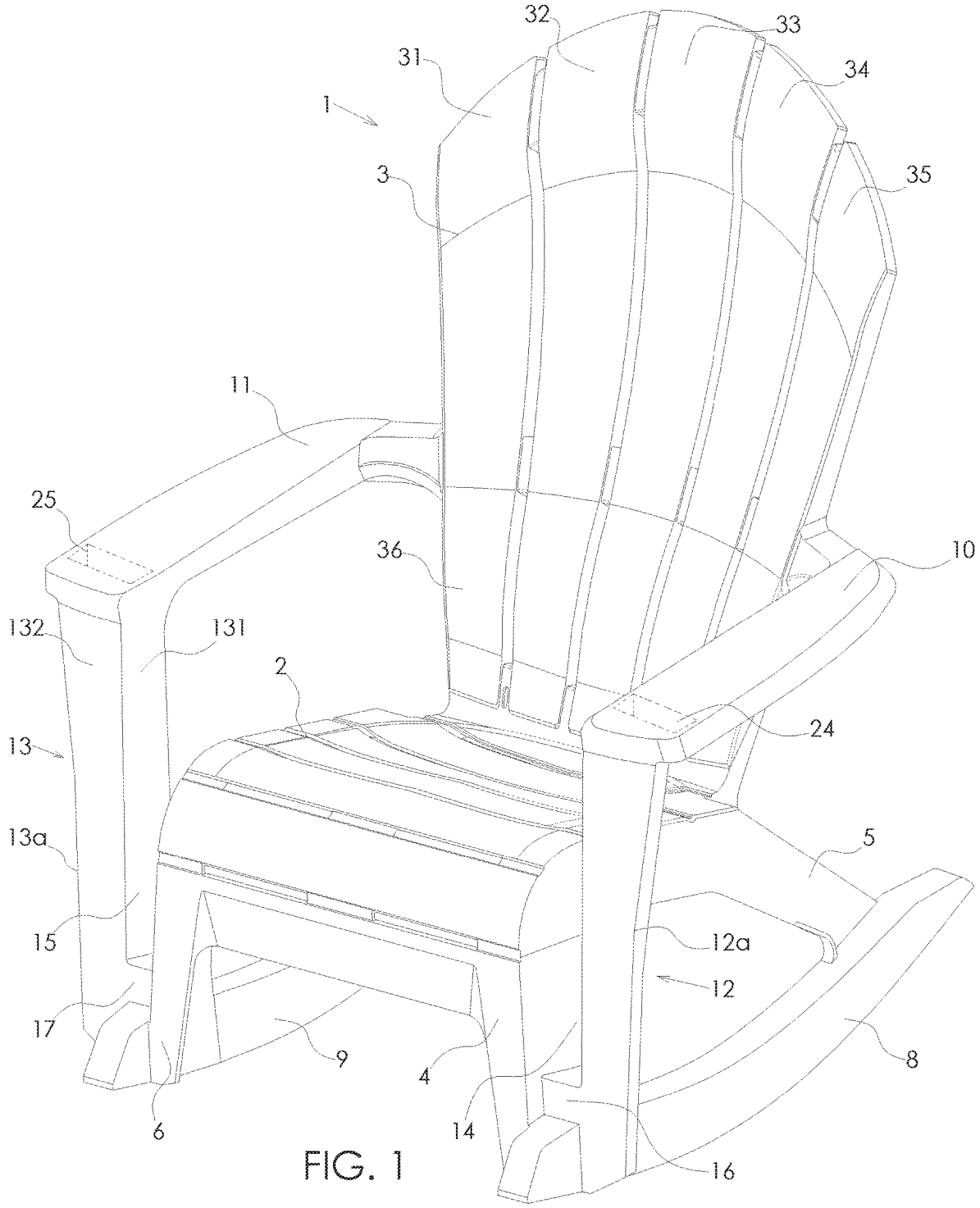
FIG. 1 is a front perspective view of a first present preferred embodiment of my stackable rocking chair.
Figure 2:
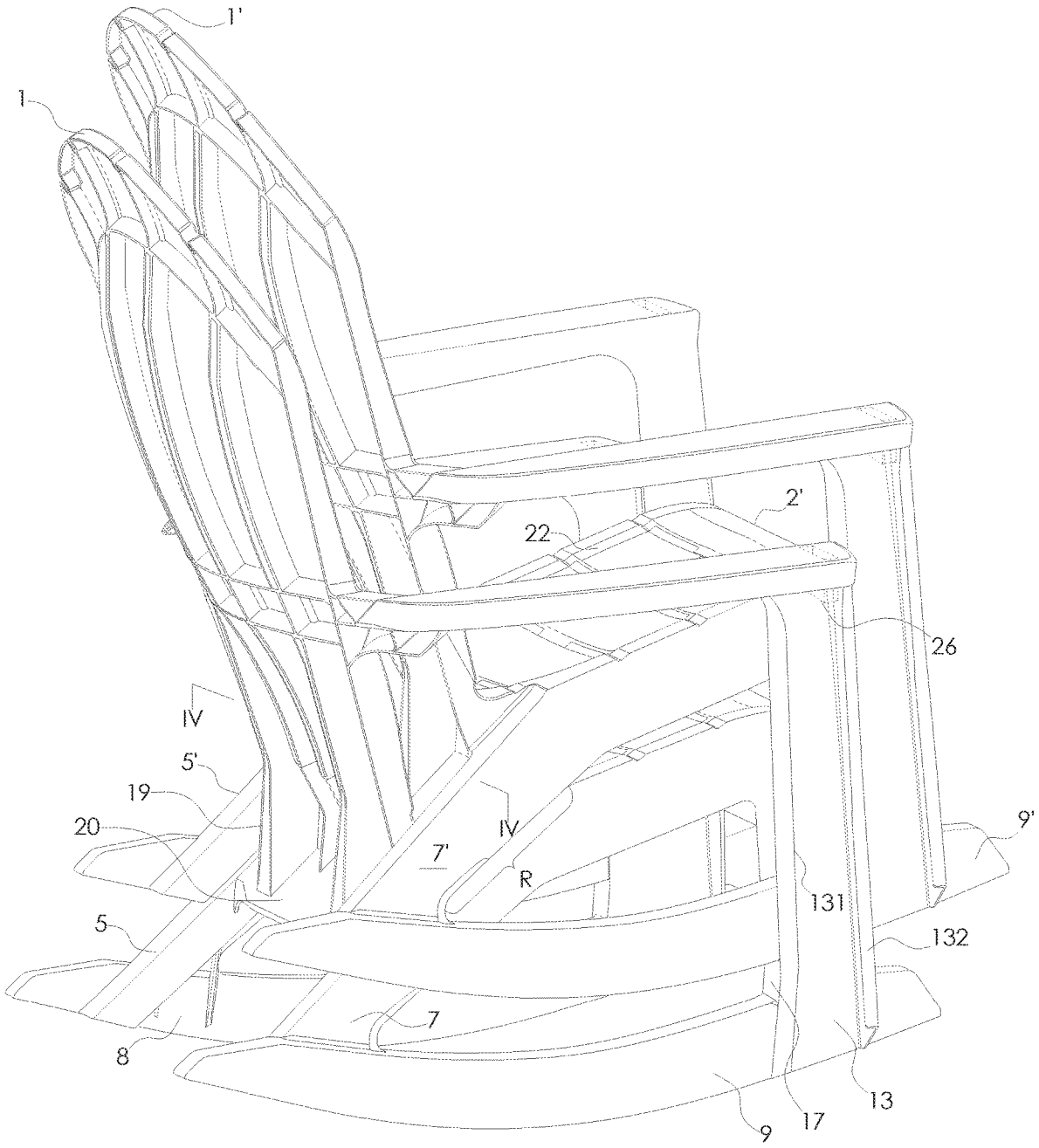
FIG. 2 is rear perspective view showing one of the stackable rocking chairs shown in FIG. 1 stacked on a second identical stackable rocking chair.
Figure 3:
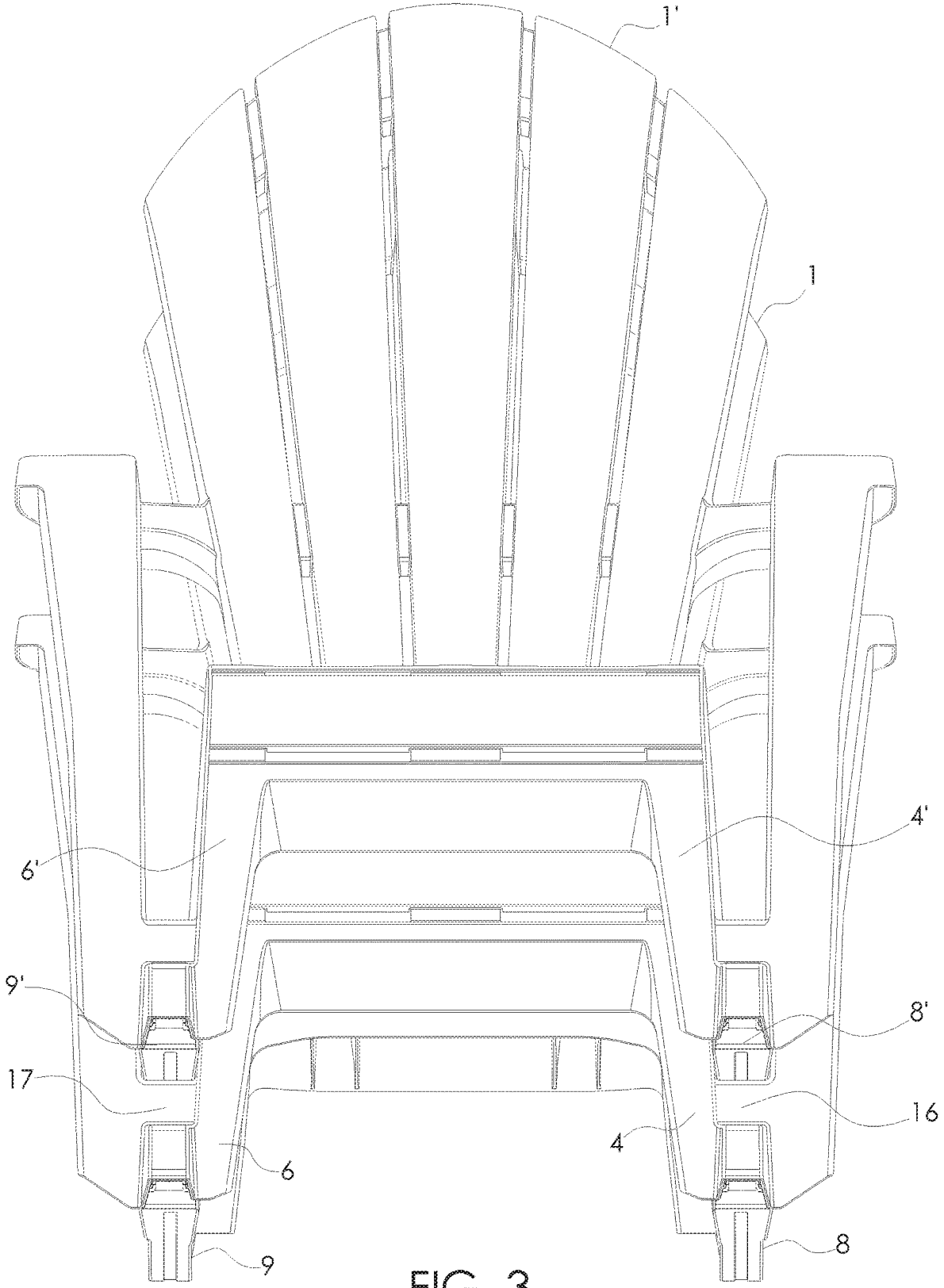
FIG. 3 is a front view of the stacked rockers shown in FIG. 2

Referring to FIGS. 1, 2 and 3 a present preferred embodiment of my stackable rocking chair 1 has a seat 2 and back 3, a left front leg 4, a left rear leg 5, a right front leg 6 and a right rear leg 7. A left rocker 8 is attached to the left front leg 4 and the left rear leg 5. A right rocker 9 is attached to the right front leg 6 and the right rear leg 7. A left arm 10 and a right arm 11 extend from the back of the chair.

A left arm support 12 has an upright 12*a* attached to the front of left arm 10 and the left rocker 8 and also has a spacer 16 between and attached to the upright 12*a* and the left front leg 4. The spacer 16 may also be attached to the left rocker 8. The upright 12*a* of the left arm support 12 is adjacent and substantially parallel to the left front leg 4, such that there is a gap 14 between the left front leg 4 and the left arm support 12. This gap 14 has a width greater than the width of the left rocker 8.

A right arm support 13 has an upright 13*a* attached to the front of right arm 11 and the right rocker 9 and also has a spacer 17 between and attached to the upright 13*a* and the right front leg 6. The spacer 17 may also be attached to the right rocker 9. The upright 13*a* of the right arm support 13 is adjacent and substantially parallel to the right front leg 6, such that there is a gap 15 between the right front leg 6 and the right arm support 13. This gap 15 has a width greater than the width of the right rocker 9.

As can be seen in FIG. 2 a portion of the bottom surface at each end of each rocker is flat. The flat portions adjacent the front end of the rockers inhibit the rocker from rocking forward a sufficient amount to cause the rocker to fall forward. The flat portions adjacent the rear end of the rockers inhibit the rocker from rocking backward a sufficient amount to cause the rocker to fall backward. The flat portions preferably are at least 3 inches in length and may be as much as 5 inches or 6 inches in length.

Figure 6:
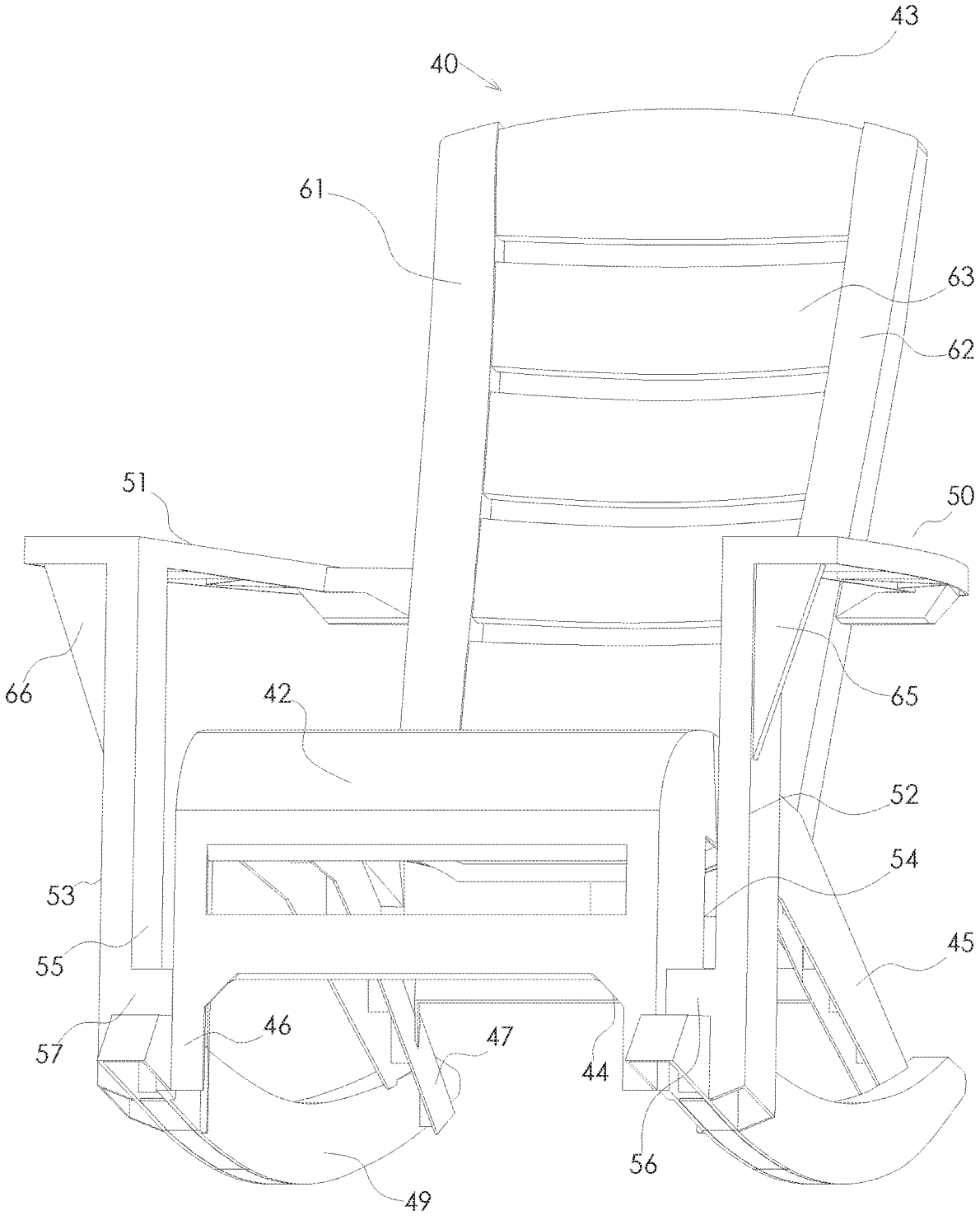
FIG. 6 is a front perspective view of a second present preferred embodiment of my stackable rocking chair.
Figure 7:
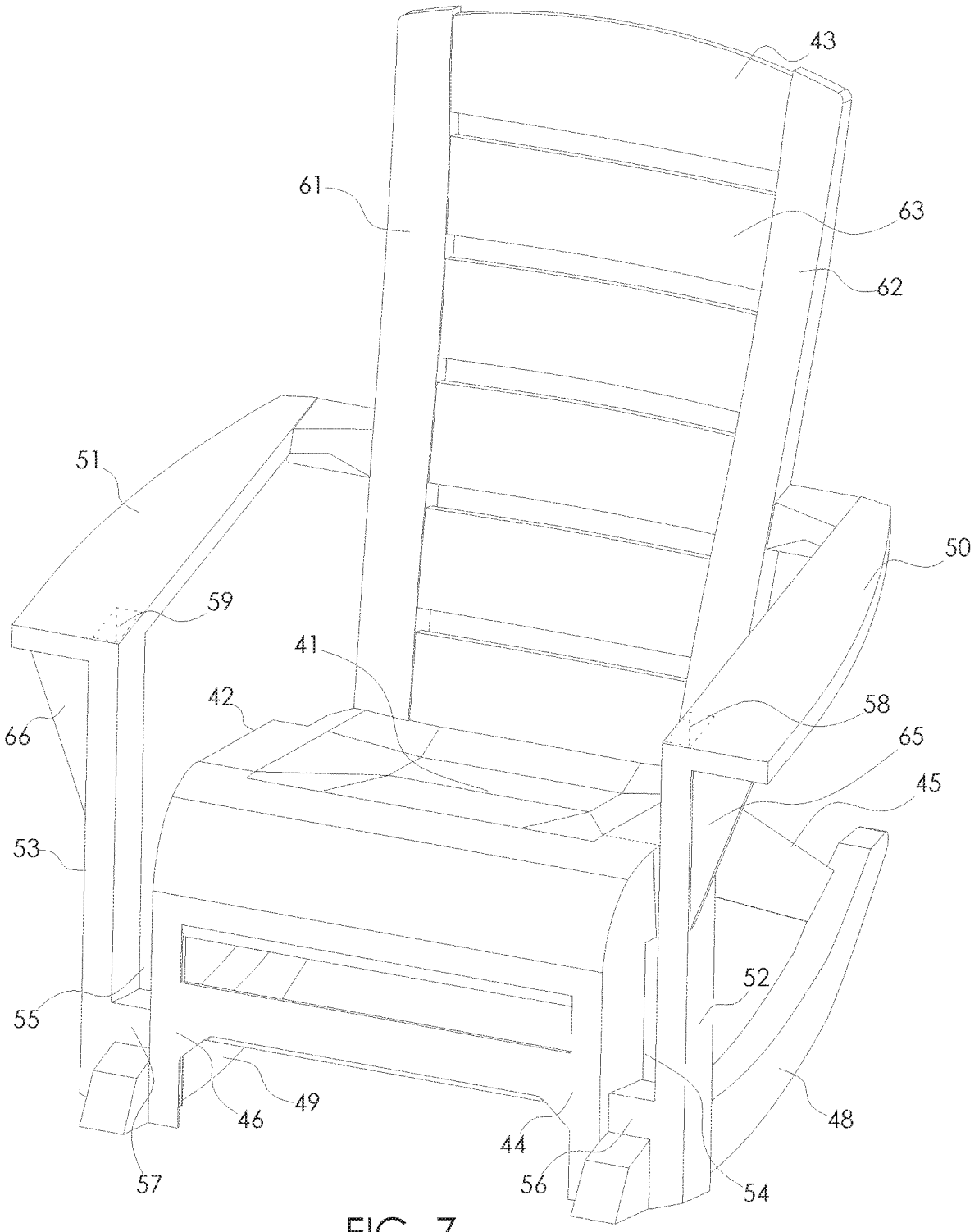
FIG. 7 is a perspective view similar to FIG. 6 in which the top of the arms and top of the seat can be seen.
Figure 8:
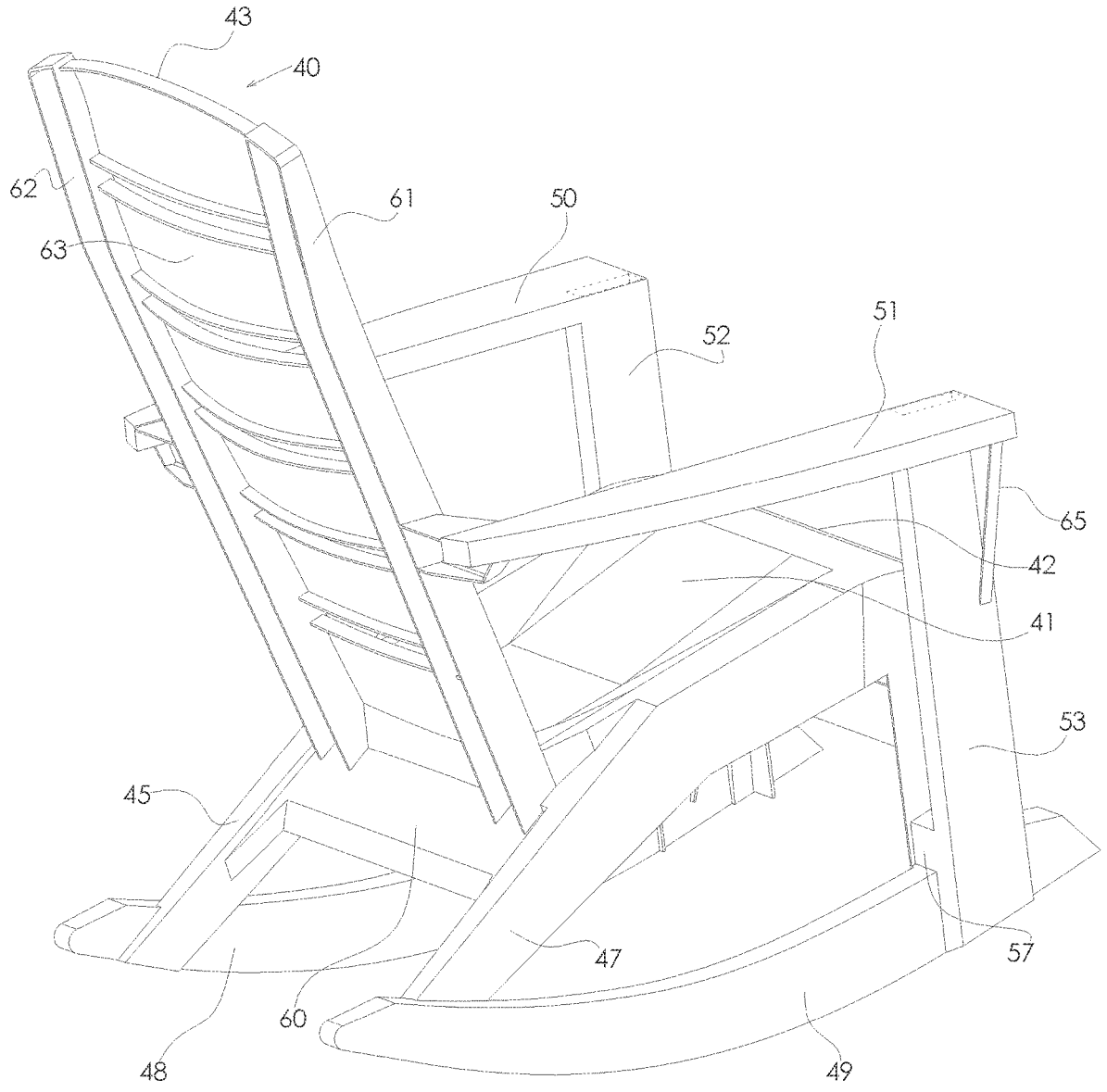
FIG. 8 is a rear perspective view of the embodiment shown in FIGS. 6 and 7.
Figure 9:
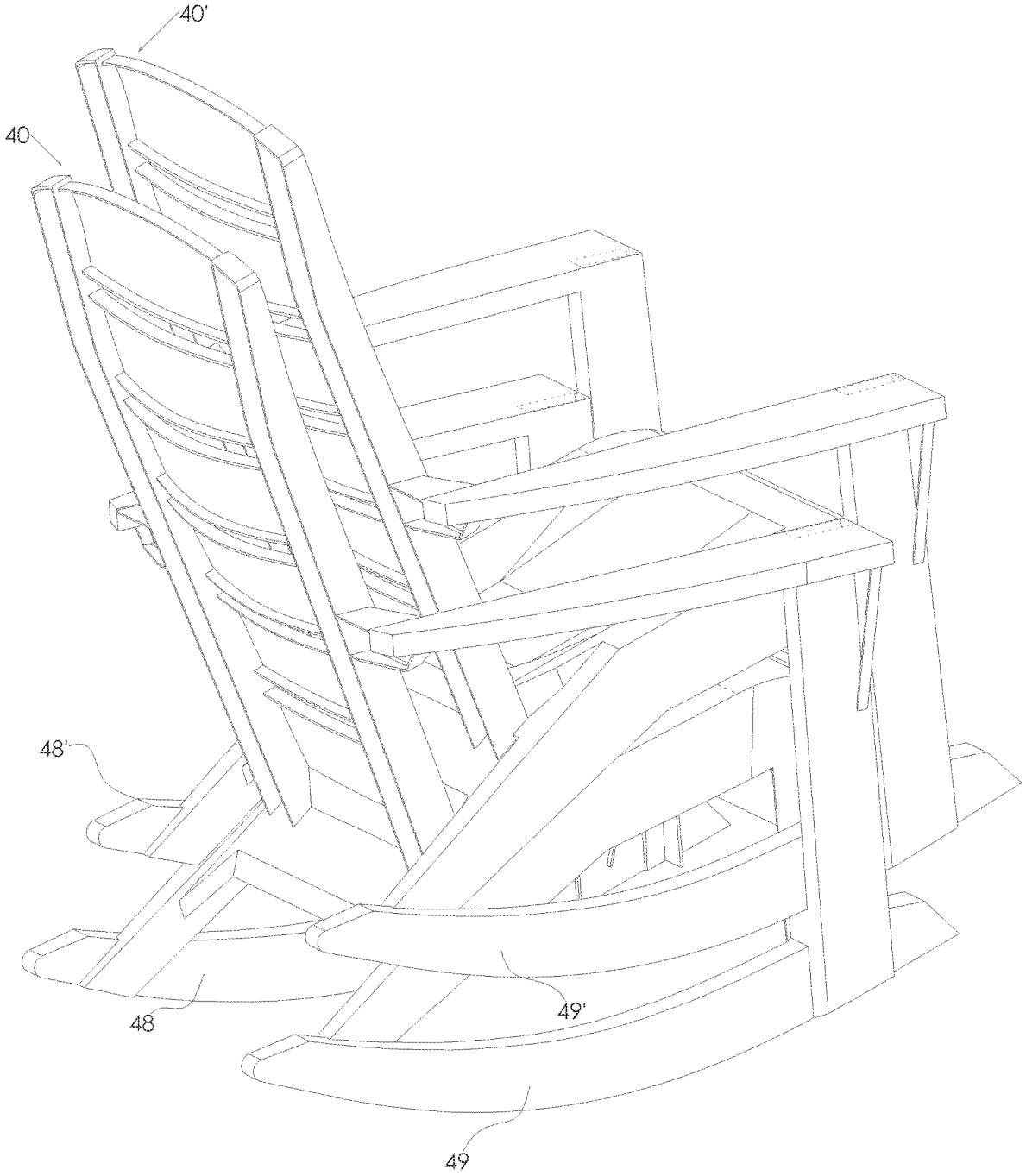
FIG. 9 is rear perspective view showing one of the stackable rocking chairs shown in FIGS. 6, 7 and 8 stacked on a second identical stackable rocking chair.

I may attach a foot which has a bottom surface made of a resilient material to the bottom surface of the right rocker and to the bottom surface of the left rocker adjacent the front end of each rocker. Each foot may extend to the front end of the rocker or be spaced a short distance from the front end of the rocker. The feet inhibit the rocker from tipping forward when the front portions of the rocker are on the floor or other flat surface. The feet should be made of a material is selected to have sufficient strength for at least partly supporting the rocker and operationally suitable abrasion resistance and friction properties with respect to its surface that is designed to contact the floor. Preferably, the feet can be made of polyvinyl chloride (PVC), thermoplastic elastomer (TPE), polyurethane, real or thermoplastic rubber, silicone, or mixtures and combinations thereof. Feet of the type disclosed in U.S. Pat. No. 10,016,058 B2 could be used. Each foot would be inserted into an opening in the bottom surface of each rocker adjacent the front end of the rocker. Suitable openings can be seen in rockers 8 and 9 in FIG. 3 and in rockers 48 and 49 in FIGS. 6 and 7.

When a second substantially identical stackable rocking chair 1' having a seat 2', a left rear leg 5', a right rear leg 7', a left rocker 8' and right rocker 9' and is stacked on my stackable rocking chair 1 the left rocker 8' of the second substantially identical rocking chair rests on the left spacer 16 and the right rocker 9' of the second substantially identical rocking chair 1' rests on the right spacer 17 and a portion of the arm support of the upper rocking chair is in contact with the upper portion of an adjacent arm support of the lower rocking chair. See FIGS. 2 and 3.

The uprights in the embodiment shown in FIGS. 1, 2 and 3 have two walls 131, 132, which form an L-shaped upright. Wall 131 is parallel to the side of the seat. Alternatively, the uprights could be a box channel or have another cross-sectional shape. Preferably the upright will have a cross-sectional shape that will allow adjacent uprights of two stacked chairs to abut one another while the chairs are in a stack.

To enable each rocker to easily fit in, and be removed from, the gap between the arm support and the front leg, the legs do not extend outward from the seat toward the upright.

When one rocking chair is stacked upon another rocking chair a front portion of each rocker 8' and 9' of the upper rocking chair 1' will rest upon a spacer 16, 17 of the lower rocking chair 1 as can been seen in FIG. 3. The spacers not only support the upper rocking chair on the lower rocking chair, but they also prevent the upper rocking chair from rocking forward.

Figure 4:
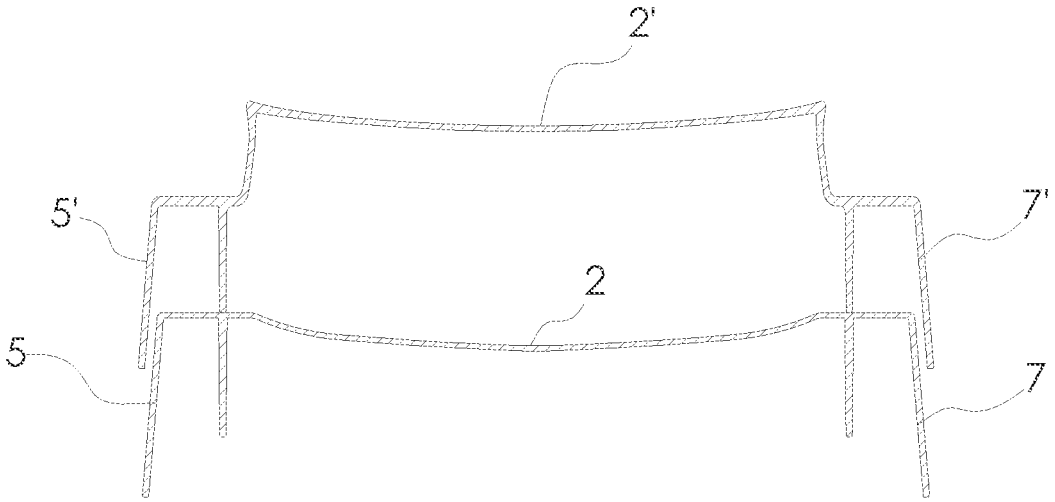
FIG. 4 is a sectional view taken along the line IV-IV in FIG. 2 showing how the rear legs stack upon one another.

A portion of each rear leg 5', 7' of the upper rocking chair 1' rests upon a portion of the lower leg 5, 7 of the lower rocking chair 1 in the region indicated by the bracket labeled with the letter R in FIG. 2. Referring to FIG. 4 I prefer that the rear legs have an inverted U-shaped cross section and that the height of the inner sidewalls of each leg is shorter than the height of the outer sidewalls. The inner sidewall is substantially perpendicular to the top of the leg, while the outer sidewall extends outward from the top of the leg away from the inner sidewall. This configuration enables the inner sidewall of each of the rear legs 5', 7' of the upper rocking chair 1' to rest on the top surface of a rear leg 5, 7 of the lower rocking chair 1. The outer sidewall of the rear legs 5', 7' of the upper rocking chair 1' extends over a portion of the outer sidewall of the legs 5, 7 of the lower rocking chair 1. This configuration supports the upper rocking chair on the lower rocking chair and prevents sideways movement of the upper rocking chair relative to the lower rocking chair. Ribs are provide between the sidewalls at spaced apart locations.

Figure 5:
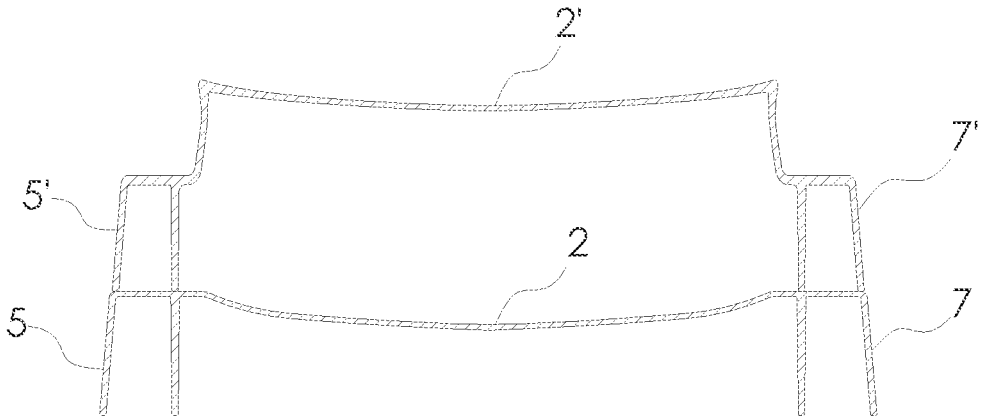
FIG. 5 is a sectional view similar to FIG. 4 showing how rear legs having a different cross-sectional shape stack upon one another.

Referring to FIG. 5, the legs may have a different cross-sectional shape in which the inner sidewall and the outer sidewall are substantially parallel and have the same height. Then both the inner sidewall and the outer sidewall of the rear legs 5', 7' of the upper rocking chair 1' rest on the top surface of a rear leg 5. 7 of the lower rocking chair. This configuration of the rear legs does not stop side to side motion but the legs are on either side of the back below it and therefore stop any side to side motion.

The rear legs extend in a backward direction relative to the seat and preferably are at an angle of from 40° to 45°, most preferably about 43°, from vertical. This configuration allows a user to easily stack one rocking chair on another rocking chair. As the upper rocking chair is placed upon the lower rocking chair the angled rear legs cause the back of the upper rocking chair to move toward the back of the lower rocking chair, nesting the two rocking chairs together. The angle of the rear legs also inhibits the upper rocking chair or chairs in the stack from falling forward. Although I prefer to provide that rear legs extend in a backward direction relative to the seat an angle of from 40° to 45° a larger angle or smaller angle can be provided as long as the as the legs are facing downhill. Then the chair will move toward the back of the chair below it. However, in a stack without a pallet, it is advantageous to provide an angle that is large enough to prevent the stack from rotating in a forward direction with each additional chair.

Having the rear legs 5 and 7 extend rearward in a direction away from the front legs 4 and 6 also provides greater stability and moves the center of gravity rearward when compared to the location of the center of gravity in conventional stacking chairs. Angling rear legs rearward provides greater stability when stacking by moving the stacking points further away from the front of the chairs. This keeps the center of mass of the full stack of chairs within the boundaries of the stacking points and the tips of the rear legs of the first chair in the stack.

As can be seen in FIG. 2, I also prefer to provide a cross member 20 between the left rear leg 5 and the right rear leg 7. A pair of braces 19 extend between the cross member 20 and the back 2. These braces enable the back to support more weight than a chair without the braces. They are important here because the arms 10, 11 in this stackable rocking chair 1 provide less support for the back than the arms in a chair in which the arm support is connected to the seat. The cross member preferably has a size and shape so that when a first rocking chair is stacked on a second rocking chair at least a portion of the cross member in the first rocking chair will rest on a portion of the seat of the second rocking chair. That portion of the seat should be near the back of the second rocking chair. If the seat is concave near the back of the rocking chair the bottom edge of the cross member can be contoured as can be seen in FIG. 3 to correspond to the contour of the seat. Contact between the cross member of the first rocking chair and the second rocking chair will provide additional support of the first rocking chair on the second rocking chair. This contact limits the rearward movement of the upper chair because the region of the crossbar which rests on the seat is a planar contact surface in the embodiment shown in FIGS. 1, 2 and 3. That surface allows the upper chair to slide into place. It also acts as a guide for the top chair to go onto the stack and coming off of the stack. The rear crossbar sets the chairs relative to each other in a stack to eliminate interference.

When a first rocking chair is stacked on a second rocking chair there are multiple points or areas of contact between the two chairs. The arm supports of the rocking chairs are together near the top of the uprights. The rockers on the upper rocking chair rest on the spacers in the lower rocking chair. The cross member of the upper chair sits on the seat or lower back of the lower rocking chair. A portion of each of the rear legs of the upper rocking chair fit over an adjacent rear leg in the second rocking chair. One or both sidewalls, depending upon the cross-sectional shape of the legs, will rest on a portion of an adjacent rear leg in the second rocking chair. These many contact points and areas provide greater stability in a stack of these rocking chairs.

The first preferred embodiment of my stackable rocking chair 1 is configured to look like an Adirondack chair. The back 3 consists of a set of spaced apart vertical slats 31, 32, 33, 34 and 35. I prefer that the lower portion of the slats to have a convex portion 36 that provides lumbar support. I also prefer that the seat 2 be a series of spaced apart slats and that the middle slats have a recessed portion 22.

A pocket 24, 25 shown in broken line in FIG. 1 may be provided in either or both arms. The pocket can be created by providing an opening in the top surface of the arm over the open end of the arm support 12, 13 and putting a floor 26 in the upright that defines the bottom of the pocket. A portion of one or both walls of the arm support can also be a wall or walls of the pocket. The pocket may be sized to hold a cell phone or other items or may be cylindrical and sized to be a cup holder.

Like the arms of an Adirondack chair the arms in the first embodiment are widest at the front of the arm where the arm 10, 11 is connected to the arm support 12, 13.

As can be seen in FIG. 2, my stackable rocking chairs do not stack along a generally vertical axis, like most stacking chairs. Rather my stackable rocking chairs stack along an axis that is about 45° from vertical. To reduce the possibility that the upper chair or chairs in a stack will fall forward, the center of gravity of the chair should be at a point near where the back joins the seat. Consequently, when a first rocking chair is stacked on a second rocking chair the center of mass of the first rocking chair will be above the seat of the second rocking chair. This is important because if the center of mass of the uppermost rocking chair in a stack is in front of the lowermost rocking chair in the stack, then the stack is more likely to fall forward. When as many as six rocking chairs like the rocking chair shown in FIGS. 1, 2 and 3 are stacked upon one another the stack will not fall forward. However, if the stack of chairs is likely to be moved or shipped I prefer to provide a custom pallet on which the chairs are stacked when more than four chairs are in the stack. This pallet would have an upright portion or portions that supports the front of the chairs.

A second present preferred embodiment of my stackable rocking chair 40 is shown in FIGS. 6 through 9. Like the first embodiment the second embodiment has a seat 42 and back 43, a left front leg 44, a left rear leg 45, a right front leg 46 and a right rear leg 47. A left rocker 48 is attached to the left front leg 44 and the left rear leg 45. A right rocker 49 is attached to the right front leg 46 and the right rear leg 47. A left arm 50 and a right arm 51 extend from the back of the chair.

A left arm support 52 consists of a single upright member having a lower end attached to the outside surface of the left rocker 48. The upper end of the left arm support 52 is attached to the front of the left arm 50. The left arm support is adjacent and substantially parallel to the left front leg, such that there is a gap 54 between the left front leg 44 and the left arm support 52. This gap 54 has a width greater than the width of the left rocker 48.

A right arm support 53 also consists of a single upright having a lower end attached to the outside surface of the right rocker 49. The upper end of the right arm support 53 is attached to the front of the right arm 51. The right arm support is adjacent and substantially parallel to the right front leg 46, such that there is a gap 55 between the right front leg 46 and the right arm support 53. This gap 55 has a width greater than the width of the right rocker 49.

Like the arms of an Adirondack chair the arms 50, 51 are widest at the front of the arm where the arm is connected to the arm support 52, 53. Because the front of the arms are wider than the arm support a brace 65, 66 is provided where the arm is connected to the arm support.

I prefer to provide a left spacer 56 attached to the left front leg 44, the left arm support 52 and the left rocker 48 and right spacer 57 attached to the right front leg 46, the right arm support 53 and the right rocker 49. When a second substantially identical stackable rocking chair 40' having a left rocker 48' and right rocker 49' and is stacked on my stackable rocking chair 40 the left rocker 48' of the second substantially identical rocking chair rests on the left spacer 56 and the right rocker 49' of the second substantially identical rocking chair 40' rests on the right spacer 57. See FIGS. 8 and 9.

I also prefer that the seat 42 have a recessed portion 41. A pocket 58, 59 shown in broken line in FIGS. 7, 8 and 9 may be provided in either or both arms 50, 51. The back 43 of this stackable rocking chair 40 has a pair of spaced-apart, parallel uprights 61, 62 and a plurality of horizontal slats 63 extending between the pair of uprights. There is a cross member 60 that extends between the left rear leg 44 and the right rear leg 45 which can be seen in FIG. 8.

This stackable rocking chair can be made of plastic in a single mold. I prefer to make this stackable rocking chair from calcium-filled polypropylene. Talc-filled polypropylene as well as polypropylene without a filler or with other fillers may also be used.

Although I have shown and described certain present preferred embodiments of my stackable rocking chair it should be distinctly understood that my invention is not limited thereto but may be variously embodied within the scope of the following claims.

I claim:

1. A stackable rocking chair comprised of:

a seat having a front edge, a right side, a left side and a back edge;

a back attached to the back edge of the seat;

a right front leg connected to the right side of the seat;

a right rear leg connected to the right side of the seat and extending away from the front leg;

a right rocker connected to the right front leg and the right rear leg, the right rocker having a width;

a right arm support having an upright, the upright having a lower end and an upper end, such that there is a gap between the right front leg and the upright, the gap having a width greater than the width of the right rocker, the upright being adjacent and substantially parallel to the right front leg;

a right arm having one end connected to the upper end of the upright of the right arm support and an opposite end connected to the back;

a left front leg connected to the left side of the seat;

a left rear leg connected to the left side of the seat and extending away from the front leg;

a left rocker connected to the left front leg and the left rear leg, the left rocker having a width;

a left arm support having an upright, the upright having a lower end and an upper end, such that there is a gap between the left front leg and the upright of the left arm support, the gap having a width greater than the width of the left rocker; the upright being adjacent and substantially parallel to the left front leg; and a left arm having one end connected to the upper end of the upright of the left arm support and an opposite end connected to the back.

2. The stackable rocking chair of claim 1 also comprising:

a first spacer connected to and between the right front leg and the lower end of the upright of the right arm support; and a second spacer connected to and between the left front leg and the lower end of the upright of the left arm support.

3. The stackable rocking chair of claim 2 also comprising a second identical stackable rocking chair having a right rocker and a left rocker, the second identical rocking chair being stacked upon the stackable rocking chair and wherein the right rocker of the second identical rocking chair rests on the first spacer and the left rocker of the second identical rocking chair rests on the second spacer.

4. The stackable rocking chair of claim 1 also comprising a cross member having one end connected to the right rear leg and an opposite end connected to the left rear leg.

5. The stackable rocking chair of claim 4 also comprising at least one brace having one end connected to the cross member and an opposite end connected to the back.

6. The stackable rocking chair of claim 1 wherein the right arm support and the left arm support are hollow, at least one of the right arm support and the left arm support having an open end with an outer edge.

7. The stackable rocking chair of claim 6 also comprising:

a right brace connected between the right arm and the right arm support; and a left brace connected between the left arm and the left arm support.

8. The stackable rocking chair of claim 6 also comprising a floor within the at least one arm support having an open end, the floor spaced apart from the outer edge.

9. The stackable rocking chair of claim 1 wherein at least one of the right arm support and the left arm support has an L-shaped cross section.

10. The stackable rocking chair of claim 1 wherein the stackable rocking chair is plastic.

11. The stackable rocking chair of claim 10 wherein the plastic is polypropylene, calcium filled polypropylene or talc filled polypropylene.

12. The stackable rocking chair of claim 1 wherein the back is comprised of a set of spaced-apart, parallel uprights, each upright having a curved upper end.

13. The stackable rocking chair of claim 1 wherein the back is comprised of a pair of spaced-apart, parallel uprights and a plurality of slats extending between the pair of uprights.

14. The stackable rocking chair of claim 1 wherein a lower portion of the back has a convex portion positioned to provide lumber support.

15. The stackable rocking chair of claim 1 wherein the rear legs extend from the seat at an angle of between 40° and 45° from vertical.

16. The stackable rocking chair of claim 1 wherein the rear legs have an inverted-U shaped cross-section comprised of a top, an inner sidewall extending from the top and an outer sidewall extending from the top.

17. The stackable rocking chair of claim 16 wherein the inner sidewall is substantially perpendicular to the top and has a first height and the outer sidewall extends away from the inner sidewall and has a second height, the first height being less than the second height.

18. The stackable rocking chair of claim 16 wherein the inner sidewall is substantially perpendicular to the top and has a first height and the outer sidewall is substantially perpendicular to the top and has a second height, the first height and the second height being a same height.

19. The stackable rocking chair of claim 1 wherein:

the right rocker has a bottom surface and a front end and a portion of the bottom surface of the right rocker adjacent the front end is flat; and the left rocker has a bottom surface and a front end and a portion of the bottom surface of the left rocker adjacent the front end is flat.

20. The stackable rocking chair of claim 19 wherein the portion of the bottom surface of the right rocker adjacent the front end which is flat and the portion of the bottom surface of the left rocker adjacent the front end which is flat each have a length of from three inches to six inches.

21. The stackable rocking chair of claim 1 wherein:

the right rocker has a bottom surface and a rear end and a portion of the bottom surface of the right rocker adjacent the rear end is flat; and the left rocker has a bottom surface and a rear end and a portion of the bottom surface of the left rocker adjacent the rear end is flat.

22. The stackable rocking chair of claim 21 wherein the portion of the bottom surface of the right rocker adjacent the rear end which is flat and the portion of the bottom surface of the left rocker adjacent the rear end which is flat each have a length of from three inches to six inches.

23. The stackable rocking chair of claim 1 wherein the right rocker has a bottom surface and a front end and the left rocker has a bottom surface and a front end also comprising:

a first foot comprised of a resilient material attached to the bottom surface of the right rocker adjacent the front end of the right rocker; and a second foot comprised of a resilient material attached to the bottom surface of the left rocker adjacent the front end of the left rocker.

24. The stackable rocking chair of claim 23 wherein the resilient material is a material selected from the group consisting of polyvinyl chloride, thermoplastic elastomer, polyurethane, real rubber, thermoplastic rubber, silicone, and mixtures and combinations thereof.

25. The stackable rocking chair of claim 1 also comprising a second identical rocking chair and wherein the left rear leg and the right rear leg of the stackable rocking chair and the second identical rocking chair each have a size and shape such that when the second identical rocking chair is stacked upon the rocking chair a portion of the left leg of the second identical rocking chair will rest upon a portion of the left leg of the rocking chair and a portion of the right leg of the second identical rocking chair will rest upon a portion of the right leg of the rocking chair.

26. A stackable rocking chair comprised of:

a seat having a front edge, a right side, a left side and a back edge;

a back attached to the back edge of the seat;

a right front leg connected to the right side of the seat;

a right rear leg connected to the right side of the seat and extending away from the front leg;

a right rocker connected to the right front leg and the right rear leg, the right rocker having a width;

a right arm support having an upright, the upright having a lower end and an upper end, such that there is a gap between the right front leg and the upright, the gap having a width greater than the width of the right rocker, the upright being adjacent and substantially parallel to the right front leg;

a right arm having one end connected to the upper end of the upright of the right arm support and an opposite end connected to the back;

a left front leg connected to the left side of the seat;

a left rear leg connected to the left side of the seat and extending away from the front leg;

a left rocker connected to the left front leg and the left rear leg, the left rocker having a width;

a left arm support having an upright, the upright having a lower end and an upper end, such that there is a gap between the left front leg and the upright of the left arm support, the gap having a width greater than the width of the left rocker; the upright being adjacent and substantially parallel to the left front leg;

a left arm having one end connected to the upper end of the upright of the left arm support and an opposite end connected to the back; and a cross member having one end connected to the right rear leg and an opposite end connected to the left rear leg, wherein the cross member has a lower edge and the cross member has a size and shape such that at least a portion of at least one of the seat and the lower edge of the cross member in a first rocking chair will rest upon a portion of the seat of a second identical rocking chair when the first rocking chair is stacked upon the second rocking chair.

* * * * *